US008264479B2

(12) United States Patent
Chen

(10) Patent No.: US 8,264,479 B2
(45) Date of Patent: Sep. 11, 2012

(54) DISPLAY CONTROL DEVICE FOR FLAT PANEL DISPLAYS AND DISPLAY DEVICE UTILIZING THE SAME

(75) Inventor: Te-Wei Chen, Taipei (TW)

(73) Assignee: Mediatek Inc., Hsin-Chu (TW)

( * ) Notice: Subject to any disclaimer, the term of this patent is extended or adjusted under 35 U.S.C. 154(b) by 591 days.

(21) Appl. No.: 12/424,561

(22) Filed: Apr. 16, 2009

(65) Prior Publication Data

US 2010/0265246 A1 Oct. 21, 2010

(51) Int. Cl.
*G09G 5/00* (2006.01)

(52) U.S. Cl. ..... 345/204

(58) Field of Classification Search ..... None
See application file for complete search history.

(56) References Cited

U.S. PATENT DOCUMENTS

| | | | | |
|---|---|---|---|---|
| 5,856,818 | A | 1/1999 | Oh et al. | |
| 2009/0096769 | A1* | 4/2009 | Kim et al. | 345/204 |
| 2010/0245339 | A1* | 9/2010 | Lin | 345/214 |
| 2010/0309392 | A1* | 12/2010 | Chen et al. | 348/790 |

FOREIGN PATENT DOCUMENTS

| | | |
|---|---|---|
| CN | 101295080 | 10/2008 |
| TW | 277029 | 3/2007 |

OTHER PUBLICATIONS

English abstract of TW277029, 2007.
English language translation of abstract of CN 101295080 (published Oct. 29, 2008).

* cited by examiner

*Primary Examiner* — Wayne Young
*Assistant Examiner* — Brian Butcher
(74) *Attorney, Agent, or Firm* — Thomas|Kayden

(57) ABSTRACT

A display control device for a flat panel display is provided and includes a display controller and a timing controller. The display controller is provided for receiving an input signal and generating a display signal and a plurality of timing signals corresponding to the display signal. The timing controller includes a timing control unit and a data processing unit. The timing control unit is coupled to the display controller for providing a plurality of control signals required for the flat panel display. The data processing unit is incorporated into the display controller in a first integrated circuit chip for receiving the display signal and generating a plurality of output signals in synchronization with the timing signals. The output signals are output to the flat panel display through a predetermined interface.

20 Claims, 5 Drawing Sheets

DISPLAY CONTROL DEVICE FOR FLAT PANEL DISPLAYS AND DISPLAY DEVICE UTILIZING THE SAME

BACKGROUND

1. Field

The disclosed embodiments relate to flat panel displays, and more particularly relate to an integrated display control device for use in a flat panel display.

2. Description of the Related Art

For conventional flat panel display devices (not shown), a timing controller is provided for determining the display sequence of image data and the timing of display cells in the flat panel display device. More specifically, after receiving image data and timing signals from a display controller of a system circuit board, the timing controller specifies the display sequence through image data transformation and generates the corresponding timing for display control of different flat panel modules.

Generally, a flat panel module of a particular specification must operate with a uniquely manufactured timing controller. In this regard, a conventional timing controller is implemented with one dedicated integrated circuit (IC) chip that may be mounted on a flat panel module in the flat panel display device, or alternatively disposed on the system circuit board for processing the image data. As such, when the specification of the flat panel module is changed, e.g., resolution or the refresh rate, the integrated circuit chip must be replaced, thereby increasing manufacturing costs. In the case where the timing controller is disposed on the flat panel module, sharing of some common elements of the timing controller with the system circuit board of the flat panel module, such as memory or power, is not available. Further, an additional cost for transmitting image data and timing signals over a low voltage differential signaling (LVDS) link is required. Although the timing controller can be implemented in the system circuit board, rather than the flat panel module, to share common elements and reduce transmission costs, overall reduction in manufacturing costs is minimal. Meanwhile, some conventional designs integrate the timing controller into the display controller, which decreases manufacturing costs due to reduced chip area and shared memory. However, since timing controllers have unique specifications for various flat panel display devices, adjustment costs are increased as chip integration results in higher manufacturing costs due to higher complexity. Thus, overall reduction in manufacturing costs is also minimal. Additionally, some conventional designs integrate the timing controller and driver circuits on the same integrated circuit chip. However, feasibility is confined to only medium-sized or small-sized flat panel modules and not to large-sized flat panel modules.

Therefore, it is crucial to provide a manufacturing technique for a flat panel display device, which provides a timing controller that can easily adapt to various types of flat panel modules, thereby improving manufacturing flexibility and efficiency of flat panel display devices.

BRIEF SUMMARY

An exemplary embodiment of a display control device for a flat panel display is provided. The display control device comprises a display controller and a timing controller. The display controller receives an input signal and generates a display signal and a plurality of timing signals corresponding to the display signal. The timing controller includes a timing control unit and a data processing unit. The timing control unit is coupled to the display controller for providing a plurality of control signals required for the flat panel display. The data processing unit is incorporated into the display controller in a first integrated circuit chip for receiving the display signal and generating a plurality of output signals in synchronization with the timing signals. The output signals are output to the flat panel display through a predetermined interface.

An exemplary embodiment of a flat panel display device is provided. The flat panel display device comprises a flat panel module, a display controller and a timing controller. The flat panel module comprises a display unit for displaying images and a plurality of driver circuits coupled to the display unit for controlling the display unit. The display controller receives an input signal and generates a display signal and a plurality of timing signals corresponding to the display signal. The timing controller comprises a timing control unit and a data processing unit. The timing control unit is coupled to the display controller for providing a plurality of control signals required for the flat panel module. The data processing unit is incorporated into the display controller in a first integrated circuit chip for receiving the display signal and generating a plurality of output signals in synchronization with the timing signals. The output signals are output to the flat panel module through a predetermined interface. Accordingly, the driver circuits receive the control signals supplied from the timing control unit and the output signals from the data processing unit through the predetermined interface, and then generate an output image corresponding to the output signals for display.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
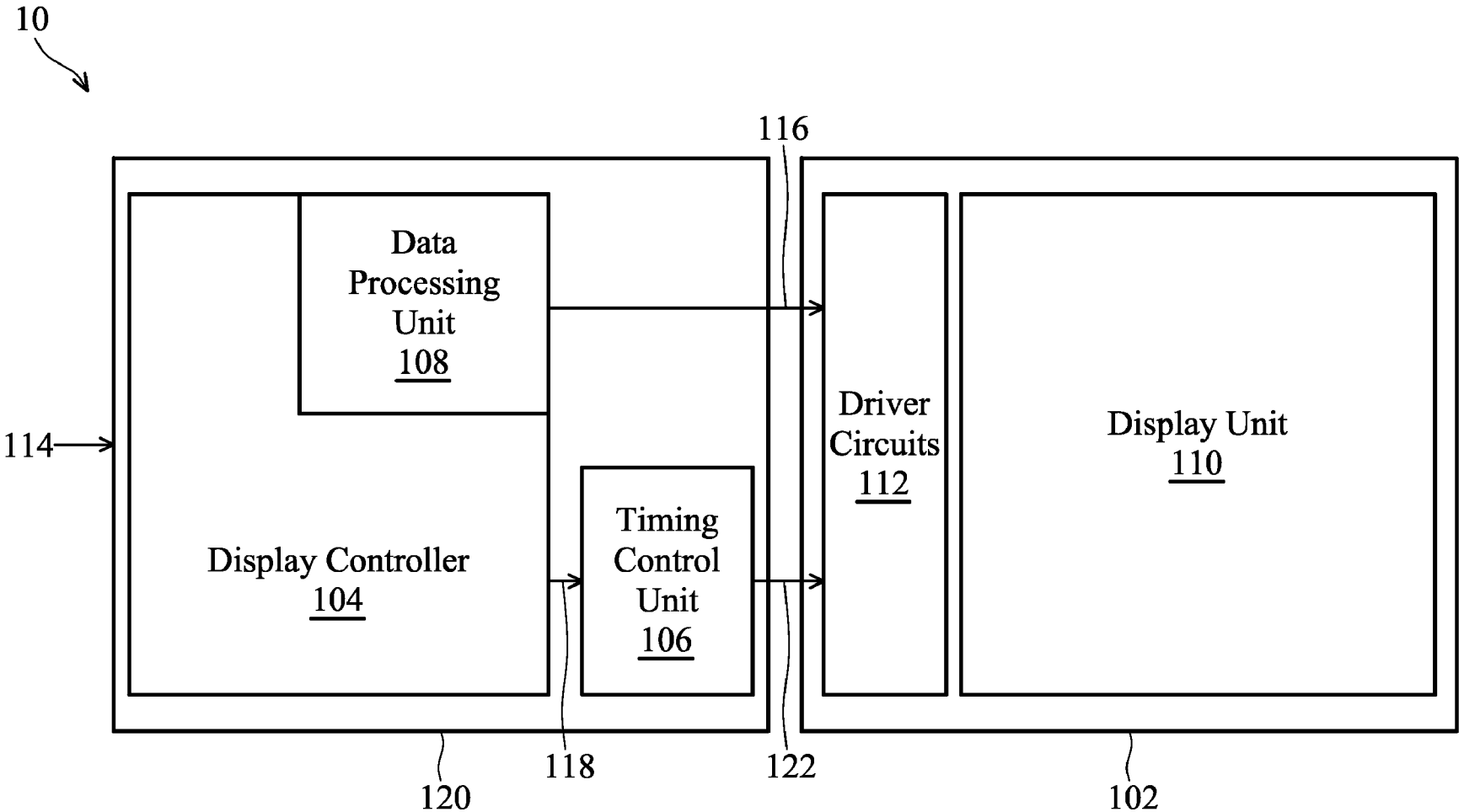
FIG. 1 shows an exemplary embodiment of a flat panel display device according to the invention.

FIG. 1 shows an exemplary embodiment of a flat panel display device 10 according to the invention. As shown in FIG. 1, the flat panel display device 10 comprises a flat panel module 102, a display controller 104 and a timing controller having a timing control unit 106 and a data processing unit 108. The flat panel module 102 comprises a display unit 110 for displaying images and a plurality of driver circuits 112 coupled to the display unit 110 for driving the display unit 110. The display controller 104 receives an input signal 114 of image data and generates a display signal (not shown) and a plurality of timing signals 118 corresponding to the display signal.

According to this embodiment, the data processing unit 108 is incorporated into the display controller 104 in one integrated circuit (IC) chip for receiving the display signal. Thus, the data processing unit 108 transforms the display signal into a plurality of output signals 116. The flat panel module 102 is connected to the data processing unit 108 for receiving the output signals 116 via a common and flexible bus interface, such as a reduced swing differential signaling (RSDS) interface or a mini-low voltage differential signaling (mini-LVDS) interface, rather than a low voltage differential signaling (LVDS) interface, thereby substantially reducing transmission costs. Note that the timing control unit 106 and the display controller 104 are individual integrated circuit chips, which may be arranged on the same package. That is, the timing control unit 106 is disposed on the same circuit board of the display controller 104, such as a system circuit board 120, thereby eliminating manufacturing cost for replacing the whole timing controller as with the prior art. In this arrangement, some elements embodied in or external to the system circuit board 120, such as a display memory or a power supply device, are configurable to be shared by the display controller 104 and the timing control unit 106.

Furthermore, the timing control unit 106 is coupled to the display controller 104 for providing a plurality of control signals 122 required for the flat panel module 102 in accordance with the timing signals 118. The control signals are provided for determining the timing of display cells in the display unit 110. Generally, the timing signals 118 are a horizontal synchronization signal (Hsync), vertical synchronization signal (Vsync), a dot clock signal (DCLK) and/or a display enable signal (DE). Thus, the control signals 122 accordingly may be a horizontal output enable signal (HOE), a vertical output enable signal (VOE), a horizontal start signal (HST), a vertical start signal (VST), a vertical clock signal (VCK), or a polarity signal (POL). For example, the timing control unit 106 provides the vertical start signal (VST) and the vertical clock signal (VCK) to a scan driver (not shown) of the driver circuits 112. Then, the scan driver synchronizes the vertical start signal (VST) with the vertical clock signal (VCK), so as to supply vertical scan signals for selecting scan lines and turning on the corresponding display cells in the display unit 110. Since operation of other timing signals for driving the display unit 110 is well known in the art, detailed description thereof is omitted. Based on the control signals 122, the driver circuits 112 then drives the display unit 110 to display an output image corresponding to the output signals 116.

More specifically, since the output signals 116 are in synchronization with the timing signals 118, it is necessary for the timing control unit 106 to have a timing synchronization circuit, such as a phase-locked loop circuit, for locking phases of the output signals 116 or timing signals 118, allowing phases of the control signals 122 to be consistent with that of the output signals 116. It is noted that in an embodiment of the invention, the timing synchronization circuit may provide a plurality of timing synchronization signals for generation of the control signals 122.

Figure 2:
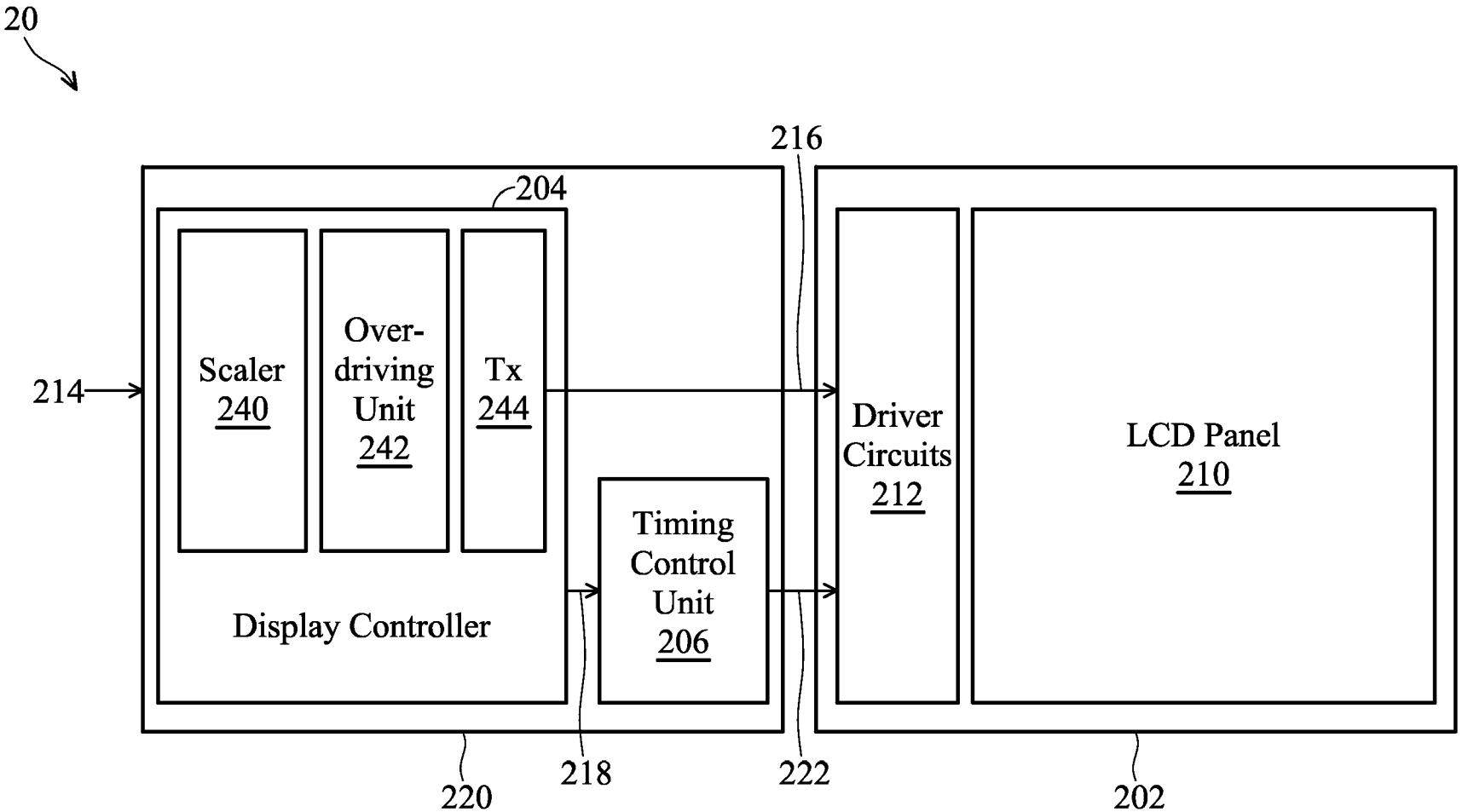
FIG. 2 is a schematic diagram illustrating an embodiment of the flat panel display device shown in FIG. 1.

FIG. 2 is a schematic diagram illustrating an embodiment of the flat panel display device shown in FIG. 1. As shown in FIG. 2, the flat panel display device 20 comprises a display controller 204, a flat panel module 202 and a timing controller having a timing control unit 206 and a data processing unit (not shown). According to this embodiment, the data processing unit comprises an over-driving unit 242. Further, the flat panel module 202 comprises a liquid crystal display (LCD) panel 210, e.g., a thin-film transistor (TFT) LCD panel, and corresponding driver circuits 212 coupled thereto.

During operation, the display controller 204, such as a TV controller, may comprise, but is not limited to, a scaler 240 for receiving and processing an input signal 214, such as a TV broadcasting signal. For example, according to the specification of the flat panel module 202, the scaler 240 may perform resolution adjustment on the input signal 214 and generate corresponding timing signals 218. Then, the over-driving unit 242 receives the scaled input signal and generates output signals 216 for compensating for the rotation speed of the liquid crystal cells in the LCD panel 210. Note that a transmitter (Tx) 244 may be further incorporated in the display controller 204 for sequentially converting and transmitting the output signals 216 to the driver circuits 212 over a reduced swing differential signaling (RSDS) link or a mini-low voltage differential signaling (mini-LVDS) link. Afterwards, the timing control unit 206 utilizes a timing synchronization circuit, such as a phase-locked loop circuit, for locking phases of the output signals 216 or timing signals 218, allowing phases of the control signals 222 to be consistent with that of the output signals 216. It is noted that in an embodiment of the invention, the timing synchronization circuit may provide a plurality of timing synchronization signals for generation of the control signals 222 required for the flat panel module 202. As a result, the driver circuits 212 drives the LCD panel 210 to display an output image according to the output signals 216 and the control signals 222.

As shown in FIG. 2, the display controller 204 and the timing control unit 206 are disposed on a system circuit board 220. The driver circuits 212 are disposed on a driver circuit board (not shown) attached to the LCD panel 210. Moreover, the scaler 240, the over-driving unit 242 and the transmitter 244 are fabricated on a single integrated circuit chip. Here, the timing control unit 206 is an individual integrated circuit chip, which is more flexible to be replaced according to the specification of the flat panel module 202. Please note that the display controller 204 is for illustrative purposes only, and is not limitative. For example, the display controller 204 may further comprise a digital TV controller and a motion estimation/motion compensation (ME/MC) unit.

Figure 3:
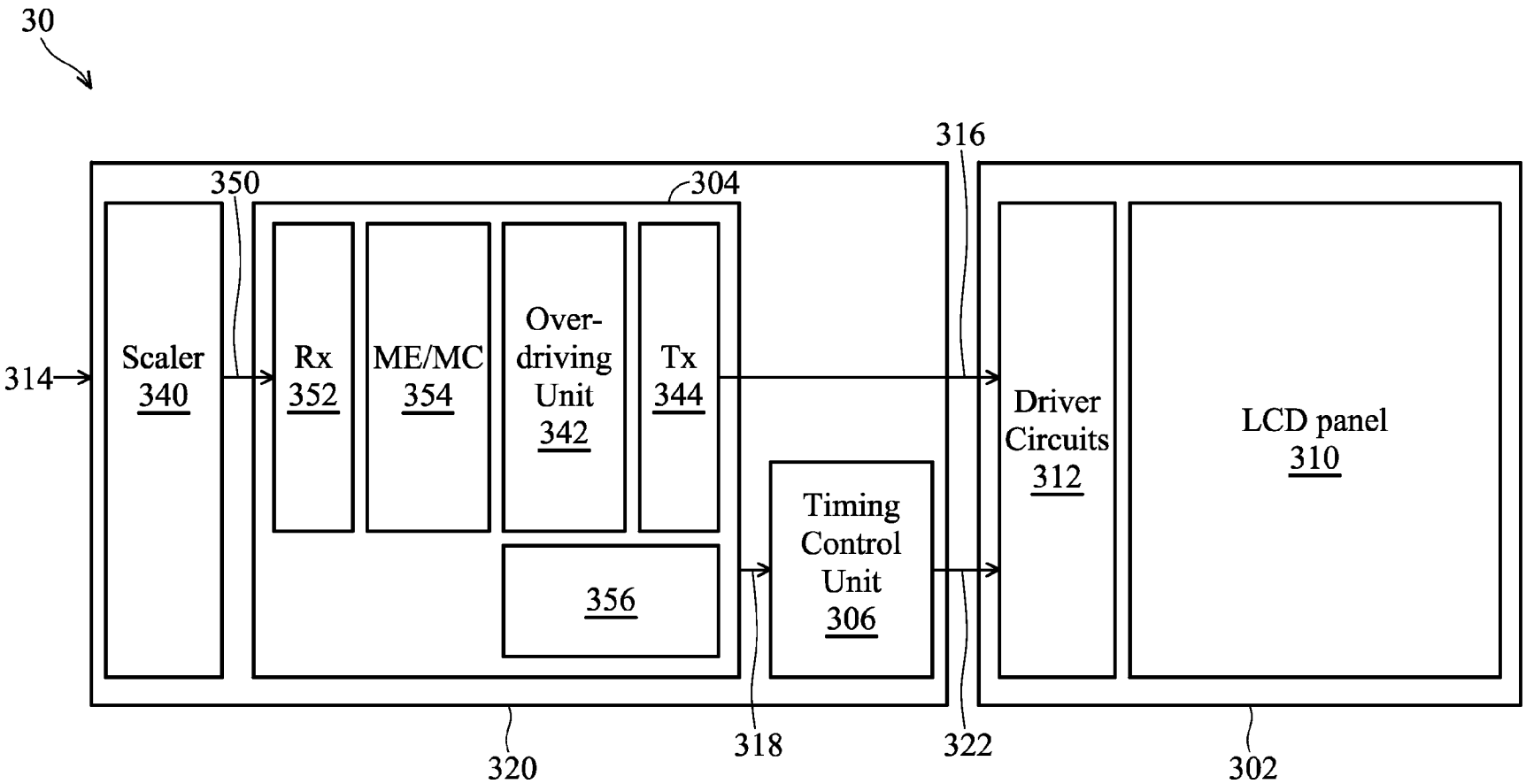
FIG. 3 is a schematic diagram illustrating another embodiment of the flat panel display device shown in FIG. 1.

FIG. 3 is a schematic diagram illustrating another embodiment of the flat panel display device shown in FIG. 1. As shown in FIG. 3, the flat panel display device 30 comprises a scaler 340 and a display controller 304, each being embodied by separate integrated circuit chips mounted on a system circuit board 320. According to an embodiment, the scaler 340 receives and adjusts an input signal 314, such as resolution adjustment, for supplying a scaled input signal 350 to the display controller 304. For example, the scaler 340 may transfer the scaled input signal 350 encoded utilizing an LVDS protocol. Further, the flat panel display device 30 comprises a flat panel module 302 having a liquid crystal display (LCD) panel 310, e.g., a thin-film transistor (TFT) LCD panel, and corresponding driver circuits 312 coupled thereto. The display controller 304 comprises a receiver (Rx) 352, a motion-estimation and motion-compensation (ME/MC) unit 354, an over-driving unit 342, and a transmitter (Tx) 344.

According to this embodiment, the receiver 352 is an LVDS receiver for converting the LVDS differential signal into a single-ended signal for further processing and providing corresponding timing signals 318. Depending on the coding standard being used, the ME/MC unit 354 involves inter-frame or intra-frame operations based on temporal and spatial correlations between display frames, thereby generating a motion-compensated prediction image signal for display. Then, the over-driving unit 342 receives the motion-compensated prediction image signal to generate output signals 316 for compensating the rotation speed of the liquid crystal cells in the LCD panel 310. The transmitter (Tx) 344 is provided for sequentially converting and transmitting the output signals 316 to the driver circuits 312 over a reduced swing differential signaling (RSDS) link or a mini-low voltage differential signaling (mini-LVDS) link. From aforementioned description, the timing control unit 306 employs a timing synchronization circuit, such as a phase-locked loop circuit, for locking phases of the output signals 316 or timing signals 318, allowing phases of the control signals 322 to be consistent with that of the output signals 316. It is noted that in an embodiment of the invention, the timing synchronization circuit may provide a plurality of timing synchronization signals for generation of the control signals 322 associated with the timing signals 318. In accordance with the control signals 322 and the output signals 316 to be displayed, the driver circuits 312 appropriately control the LCD panel 310 to display an output image. It is noted that the display controller 304 may further comprise an embedded timing control unit 356 that can be optionally substituted for the timing control unit 306 and additionally provided for controlling the flat panel module 302 of a different specification.

In the embodiment of FIG. 3, the receiver 352, the ME/MC unit 354, the over-driving unit 342 and the transmitter 344 are incorporated into the display controller 304 of a single integrated circuit chip. The scaler 340 and the timing control unit 306 are fabricated on two individual integrated circuit chips. Moreover, the scaler 340, the display controller 304 and the timing control unit 306 are respectively disposed on the system circuit board 320. That is, the timing control unit 306 of an individual integrated circuit chip allows for easy exchange of the embedded timing control unit 356 or efficient replacement of other timing control units. According to one embodiment, the driver circuits 312 are disposed on a driver circuit board (not shown) attached to the LCD panel 310. According to another embodiment, the driver circuits 312 are fabricated onto an integrated circuit chip attached to the LCD panel 310.

Figure 4:
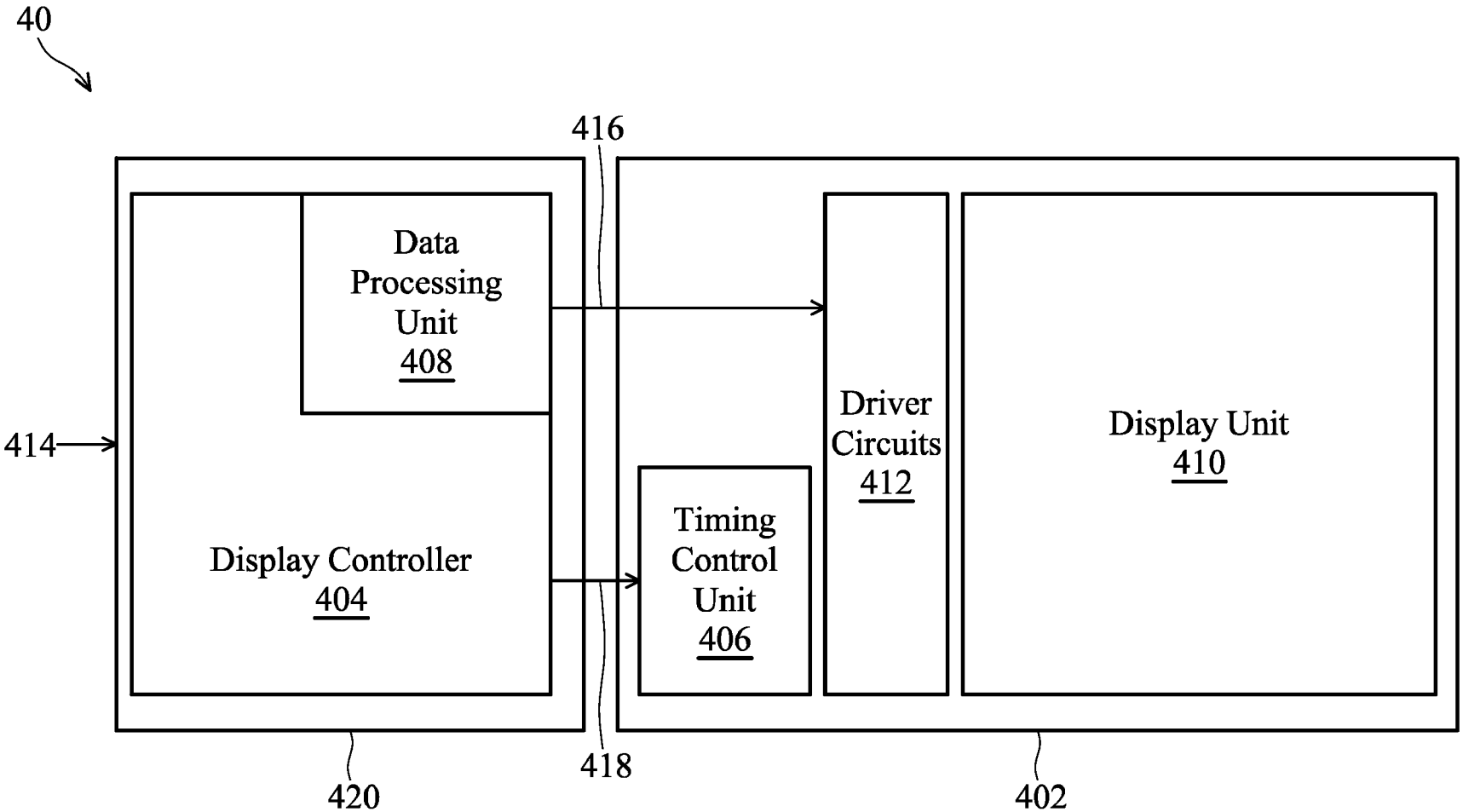
FIG. 4 shows another exemplary embodiment of a flat panel display device according to the invention.

FIG. 4 shows another exemplary embodiment of a flat panel display device 40 according to the invention. As shown in FIG. 4, the flat panel display device 40 comprises a flat panel module 402 and a display controller 404.

In this embodiment, a timing controller has a data processing unit 408 and a timing control unit 406 respectively incorporated into the display controller 404 and the flat panel module 402. In addition, the flat panel module 402 comprises a display unit 410 for displaying images and a plurality of driver circuits 412 coupled thereto. As described previously, the display controller 404 receives an input signal 414 of image data. Then, the display controller 404 provides a display signal (not shown) to the data processing unit 408 for generating a plurality of output signals 416 with respect to the display sequence of image data. The display controller 404 also provides a plurality of timing signals 418 to the timing control unit 406. Note that structures and operations in the display controller 404 and the timing control unit 406 are substantially similar to those of FIGS. 1, 2 and 3; therefore, further descriptions are omitted for brevity.

In this illustrated embodiment, the timing control unit 406 and the driver circuits 412 are two individual integrated circuit chips coupled together to the display unit 410. Further, the display controller 404 may be mounted on a system circuit board 420. In this arrangement, when the specification of the display unit 410 is varied, the driver circuits 412 and the timing control unit 406 can be adapted accordingly in a cost effective and efficient manner.

Figure 5:
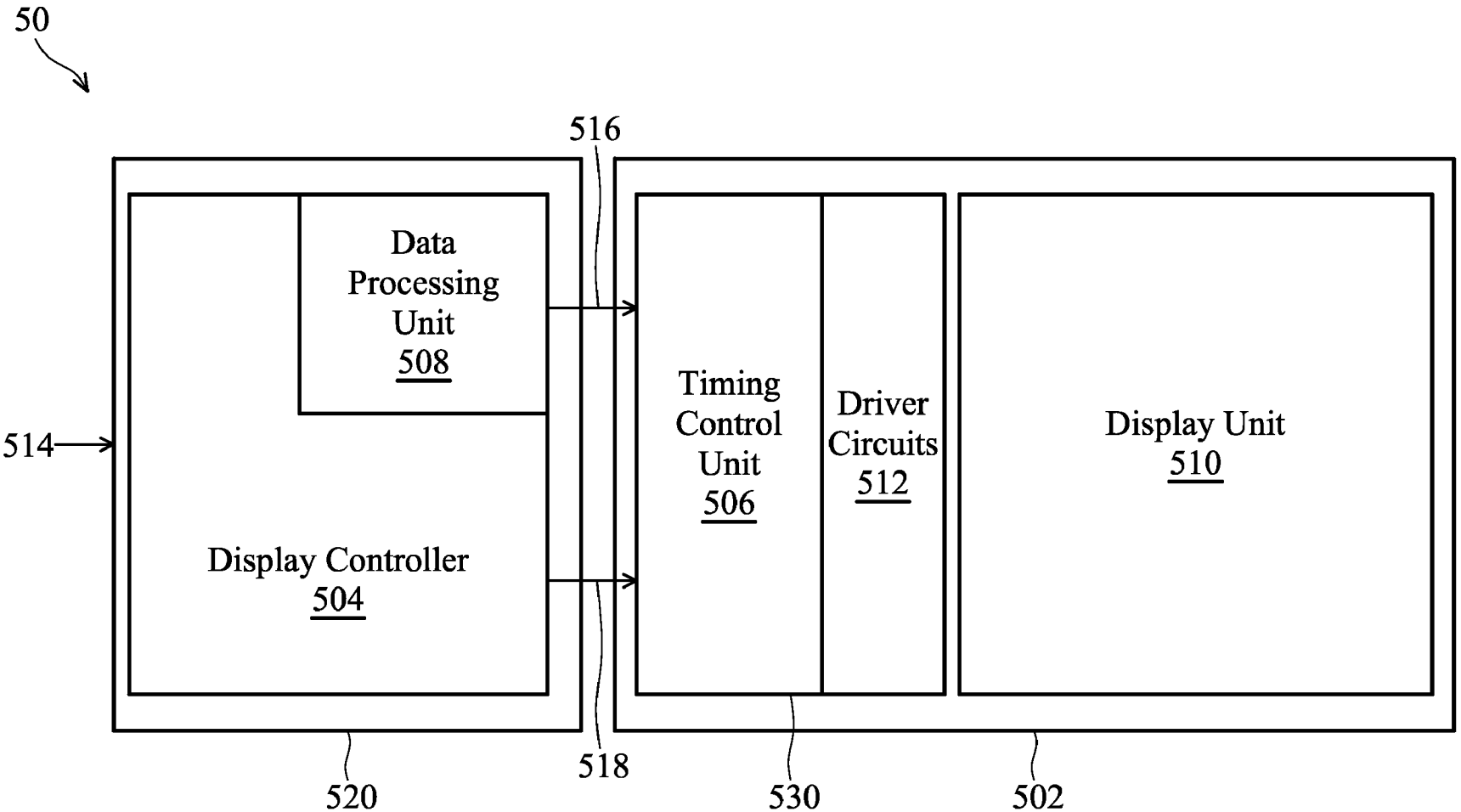
FIG. 5 shows another exemplary embodiment of a flat panel display device according to the invention.

FIG. 5 shows another exemplary embodiment of a flat panel display device according to the invention. As shown in FIG. 5, the flat panel display device 50 comprises a flat panel module 502 and a display controller 504.

According to this embodiment, a timing controller has a data processing unit 508 and a timing control unit 506 respectively incorporated into the display controller 504 and the flat panel module 502. Further, the flat panel module 502 comprises a display unit 510 for displaying images and a plurality of driver circuits 512 coupled thereto. As described above, the display controller 504 receives an input signal 514 of image data. Then, the display controller 504 provides a display signal (not shown) to the data processing unit 508 for generating a plurality of output signals 516 related to the display sequence of image data. The display controller 504 also provides a plurality of timing signals 518 to the timing control unit 506. Referring to FIGS. 4 and 5, the arrangement shown in FIG. 5 is of a similar design to the arrangement shown in FIG. 4. However, unlike the arrangement shown in FIG. 4, the timing control unit 506 is instead incorporated into the driver circuits 512 in a single integrated circuit chip 530, which is further mounted on the display unit 510. Thus, manufacturing and transmission costs are accordingly lowered. Moreover, in some embodiments, because the timing control unit 506 receives the output signals 516 and the timing signals 518 simultaneously, the timing control unit 506 may not need a timing synchronization circuit for synchronizing the output signals 516 with the timing signals 518, thereby simplifying the display control process.

The invention provides significant improvement over prior art by disposing a conventional timing controller into a timing control unit and a data processing unit. The data processing unit is integrated into a display controller regardless of the specification of the flat panel module. Thus, some resources (e.g., a power supply device) can be shared and significant manufacturing and transmission cost advantages are obtained. Additionally, the timing control unit of a single integrated circuit chip can be easily replaced for supporting different flat panel modules. As a result, manufacturing flexibility and efficiency are further improved.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A display control device for a flat panel display, comprising:

a display controller for receiving an input signal and generating a display signal and a plurality of timing signals corresponding to the display signal; and a timing controller having a timing control unit and a data processing unit, wherein the timing control unit is coupled to the display controller for providing a plurality of control signals required for the flat panel display, and the timing control unit and the data processing unit are embodied in separate integrated circuit chips, and wherein the data processing unit is incorporated into the display controller in a first integrated circuit chip for receiving the display signal and generating a plurality of output signals in synchronization with the timing signals, and the output signals are output to the flat panel display through a predetermined interface.

2. The display control device as claimed in claim 1, wherein the timing control unit comprises:

a timing synchronization circuit configurable to provide a plurality of timing synchronization signals according to the timing signals, wherein the control signals are generated on the basis of the timing synchronization signals.

3. The display control device as claimed in claim 1, wherein the timing control unit and the display controller are disposed on a first circuit board.

4. The display control device as claimed in claim 1, wherein the timing control unit is disposed on a second circuit board attached to the flat panel display.

5. The display control device as claimed in claim 1, wherein the timing control unit is incorporated in a second integrated circuit chip mounted on the flat panel display.

6. The display control device as claimed in claim 1, wherein the predetermined interface is a reduced swing differential signaling interface.

7. The display control device as claimed in claim 1, wherein the predetermined interface is a mini-low voltage differential signaling interface.

8. The display control device as claimed in claim 2, wherein the timing synchronization circuit is a phase-locked loop circuit.

9. The display control device as claimed in claim 1, wherein the timing signals are horizontal synchronization signals, vertical synchronization signals, a dot clock signals, display enable signals, or combinations thereof.

10. The display control device as claimed in claim 1, wherein the control signals are horizontal output enable signals, vertical output enable signals, horizontal start signals, vertical start signals, vertical clock signals, polarity signals, or combinations thereof.

11. A flat panel display device, comprising:

a flat panel module having a display unit for displaying images and a plurality of driver circuits coupled to the display unit for controlling the display unit;

a display controller for receiving an input signal and generating a display signal and a plurality of timing signals corresponding to the display signal; and a timing controller having a timing control unit and a data processing unit, wherein the timing control unit is coupled to the display controller for providing a plurality of control signals required for the flat panel module, and the timing control unit and the data processing unit are embodied in separate integrated circuit chips, and wherein the data processing unit is incorporated into the display controller in a first integrated circuit chip for receiving the display signal and generating a plurality of output signals in synchronization with the timing signals, and the output signals are output to the flat panel module through a predetermined interface, wherein the driver circuits receive the control signals supplied from the timing control unit and output signals from the data processing unit through the predetermined interface, and generate an output image corresponding to the output signals for display.

12. The flat panel display device as claimed in claim 11, wherein the timing control unit comprises:

a timing synchronization circuit configurable to provide a plurality of timing synchronization signals according to the timing signals, wherein the control signals are generated on the basis of the timing synchronization signals.

13. The flat panel display device as claimed in claim 11, wherein the timing control unit and the display controller are disposed on a first circuit board.

14. The flat panel display device as claimed in claim 11, wherein the timing control unit and the driver circuits are disposed on a second circuit board attached to the display unit.

15. The flat panel display device as claimed in claim 11, wherein the timing control unit is incorporated into the driver circuits in a second integrated circuit chip mounted on the display unit.

16. The flat panel display device as claimed in claim 11, wherein the predetermined interface is a reduced swing differential signaling interface.

17. The flat panel display device as claimed in claim 11, wherein the predetermined interface is a mini-low voltage differential signaling interface.

18. The flat panel display device as claimed in claim 12, wherein the timing synchronization circuit is a phase-locked loop circuit.

19. The flat panel display device as claimed in claim 11, wherein the timing signals are horizontal synchronization signal, vertical synchronization signals, dot clock signals, display enable signals, or combinations thereof.

20. The flat panel display device as claimed in claim 11, wherein the control signals are horizontal output enable signals, vertical output enable signals, horizontal start signals, vertical start signals, vertical clock signals, polarity signals, or combinations thereof.

* * * * *